United States Patent [19]

Litter

[11] Patent Number: 4,628,827

[45] Date of Patent: Dec. 16, 1986

[54] STORAGE VAULT FOR VALUABLES

[76] Inventor: R. Mark Litter, 1725 Sandusky County Rd. 41, Fremont, Ohio 43420

[21] Appl. No.: 605,232

[22] Filed: Apr. 30, 1984

[51] Int. Cl.[4] ..... E05G 1/00; B65D 25/24

[52] U.S. Cl. ..... 109/50; 220/18; 220/72; 109/75

[58] Field of Search ..... 109/1 S, 24, 50, 53, 109/58, 64, 68, 75; 220/22.3, 306–308, 72, 18, 262, 263

[56] References Cited

U.S. PATENT DOCUMENTS

| | | | |
|---|---|---|---|
| 2,985,333 | 5/1961 | Kirkman | 220/22.3 |
| 3,376,996 | 4/1968 | Bardell | 220/308 |
| 3,458,079 | 7/1969 | Gasbarra | 220/308 |
| 3,510,023 | 5/1970 | Ullman et al. | 220/308 |
| 3,515,306 | 6/1970 | Roper et al. | 220/72 |
| 3,656,650 | 4/1972 | Frater | 220/22.3 |
| 3,662,918 | 5/1972 | Crawford | 220/72 |
| 3,804,289 | 4/1974 | Churan | 220/72 |
| 3,893,584 | 7/1975 | Ledford | 220/18 |
| 3,945,329 | 3/1976 | Bywater | 109/68 |
| 4,261,464 | 4/1981 | Maitland | 220/22.3 |
| 4,262,607 | 4/1981 | Krebs | 109/58 |
| 4,405,057 | 9/1983 | Stein | 220/346 |
| 4,408,546 | 10/1983 | Schmidt | 109/75 |

*Primary Examiner*—Gary L. Smith
*Assistant Examiner*—Neill Wilson
*Attorney, Agent, or Firm*—Richard C. Darr

[57] ABSTRACT

A vault for secure underground storage of valuables, comprising a one-piece molded container of a non-magnetic material and a removable lid for the container which, when in place on the container, prevents entry of moisture thereinto. An integral flange projecting outwardly from the container around its periphery is adapted to be embedded in the surrounding earth when the container is buried to thereby prevent the vault from being lifted due to its natural buoyancy should the water table in the earth rise above the bottom of the vault. Movable partitions are provided within the container for accommodating papers and other valuables of differing sizes and configurations.

8 Claims, 4 Drawing Figures

STORAGE VAULT FOR VALUABLES

BACKGROUND OF THE INVENTION

1. Field of the Invention

This invention generally pertains to storage receptacles for valuables, and more particularly to vaults for such valuables which can be buried underground at a location known only to selected persons and which, when in place, are not susceptible to detection by conventional metal detectors.

2. Description of the Prior Art

Due to the seemingly ever-increasing rate of crime, and particularly the high incidence of home and business burglaries, there is great concern over the security of certain papers, documents, currency, stocks, bonds and other items normally kept in the home or office of a small business. In order to provide a measure of security for such items, a number of small, personal-sized safes have been developed and are commercially available. However, such safes, if they are of high quality, are rather expensive and even then provide limited security inasmuch as they can be opened with relative ease by skilled burglars, using appropriate tools, or simply removed from the premises by those with less skill and opened at another location.

Safes such as those shown in U.S. Pat. Nos. 3,945,329 and 4,403,546, which are adapted to be built into concrete walls or floors to provide greater security, have limited utility since their cost puts them beyond the reach of many people. Another solution has been to store such items in a rented safety deposit box in the vault of a financial institution. This alternative is not feasible in many instances due to factors such as cost, inconvenience, loss of privacy and lack of access except during the relatively limited business hours of the financial institution. Thus, while security devices are readily available, there remains a need for a relatively simple, inexpensive device.

SUMMARY OF THE INVENTION

To that end, the present invention includes a one piece molded container of a durable, moisture-impervious, non-magnetic material such as plastic, having an integral outwardly projecting flange extending around its periphery. Movable partitions are provided within the container for selectively dividing the interior to accomodate articles, documents and papers of different sizes and configurations. The container includes a removable closure member or lid having a highly effective sealing means for preventing entry of moisture when the closed container is disposed within the earth.

It is, therefore, a primary object of the invention to provide a storage vault for valuables which is inexpensive and highly effective.

Another object of the invention is to provide a storage vault which permits the user to maintain complete privacy and confidentiality in the security of his valuables.

Another object of the invention is to provide an underground storage device which is not susceptible to detection by conventional magnetic detection devices.

Still another object is to provide such an underground storage device which will resist upwardly buoyant forces should it become subjected to them due to the level of the water table while embedded in the earth.

Other objects and advantages will become more apparent during the course of the following description when taken in connection with the accompanying drawings.

BRIEF DESCRIPTION OF THE DRAWINGS

In the drawings, wherein like numerals refer to like parts throughout.

DESCRIPTION OF THE PREFERRED EMBODIMENT

Figure 1:
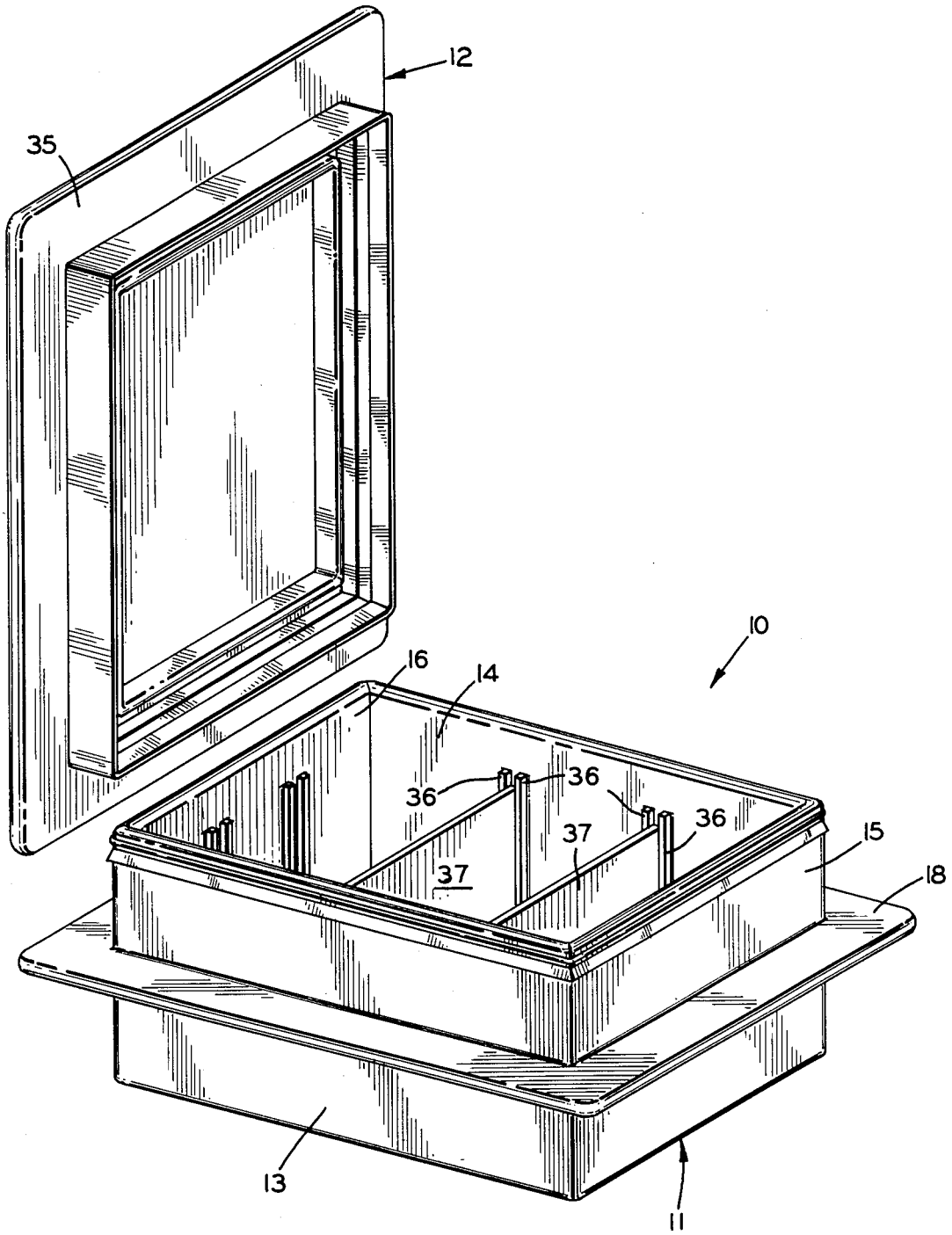
FIG. 1 is a perspective view of a storage Vault constructed in accordance with the invention, with the lid in an open position.

Referring now to the drawings, there is shown generally at 10 in FIG. 1 a vault for underground placement constructed in accordance with the invention. More particularly the vault includes a receptacle or container 11 and a matching lid 12, each preferably of one-piece molded construction and preferably formed of one of the dense, tough, resilient, impervious plastics well known in the art. The material from which the receptacle and lid are formed must in any event be inert to the body in which the vault is to be buried, generally the earth. Since it is the purpose of the invention to permit burial of the vault in a location known only to the user and other selected individuals, it is highly desirable that, when in place, it not be capable of detection by conventional locating means. To that end, the material should be non-magnetic in nature so that the buried vault will not activate metal detectors widely in use for finding buried objects.

Figure 2:
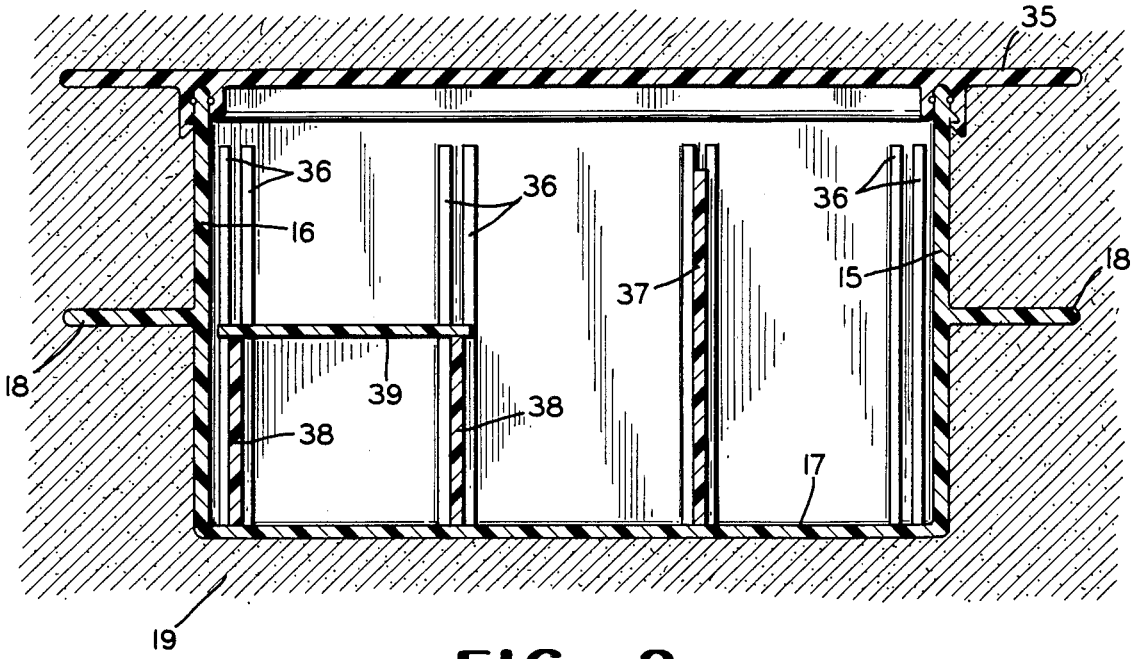
FIG. 2 is a vertical, longitudinal section through the container buried in the earth and with the lid in place.

The vault 10 may be constructed in different shapes and sizes to accommodate the particular objects to be stored and, as will be hereinafter described, is also provided with optional moveable interior dividers to create individual compartments or sections of selected sizes and configurations. The receptacle or container 11 comprises side walls 13 and 14, end walls 15 and 16 and a bottom wall 17, all preferably formed as an integral unit as by conventional plastics molding techniques so as to insure the moisture proof integrity of the unit. A flange 18 projects outwardly from the side and end walls around the periphery of the container, and is adapted to project into the surrounding earth 19 as illustrated in FIG. 2 when the vault is buried. The flange should be of sufficient width to anchor the vault and prevent upward movement should the level of the water table in the earth 19 rise above the bottom wall 17 so that a buoyant upward force is exerted upon the vault. Since the vault normally need not be buried more than a few inches below the surface of the earth, this situation will generally exist only during a rainy season or in an area having an unusally high water table.

Figure 3:
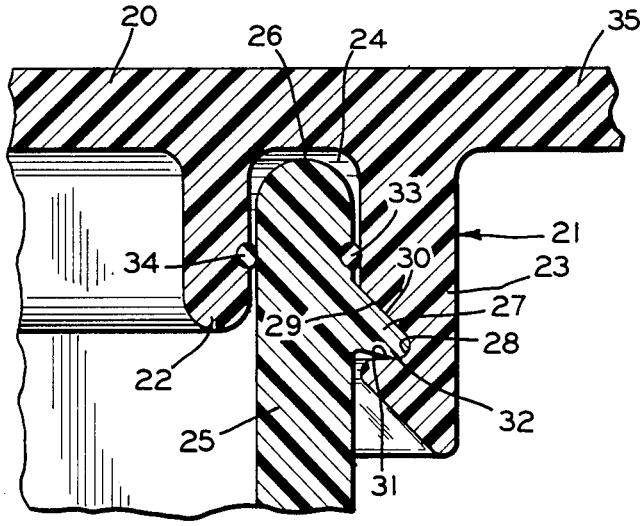
FIG. 3 is an enlarged fragmentary view of the juncture of the lid and container illustrating the locking and sealing arrangement therebetween.

The lid 12 for the vault again is preferably a one-piece molded unit so as to be moisture-impervious, and comprises a flat cover 20 having a continuous securing mechanism 21 for receiving the upper margins of the walls 13, 14, 15 and 16. As best shown in FIGS. 2 and 3, the securing mechanism includes an interior flange 22 and an exterior flange 23 depending from the cover 20 and defining therebetween a continuous channel 24 for receiving the upper margin 25 of each of the walls 13, 14, 15 and 16. In order to facilitate application of the lid 12 to the receptacle 11, the tops of the walls are rounded as at 26.

The configuration of the juncture between the receptacle 11 and the lid 12 is such as to provide a sequence of barriers to the passage of moisture from the exterior to the interior of the vault. To this end, the exterior of the upper margin 25 of the walls 13, 14, 15 and 16 is provided with a projection 27 adapted to be received within a mating recess 28 in the exterior flange 23. The projection has a downwardly sloping face 29 which abuts a similarly sloping face 30 within the recess 28 in the assembled state. The bottom wall 31 of the recess 28 engages beneath a lip 32 on the projection 27 and slopes slightly upwardly so as to constantly urge the faces 29 and 30 into abutting relationship. The faces thus not only are pressed against one another in sealing relationship, but also present an upwardly directed path along which moisture would have to move to enter the channel 24.

Two additional barriers to the passage of moisture are created by first and second gaskets 33 and 34 located within channel 24. More specifically, the first gasket 33 is in the nature of an 0-ring extending entirely around the container 11 and partially embedded in the exterior of the walls 13, 14, 15 and 16. The second gasket 34 similarly is in the nature of an 0-ring extending entirely around and partially embedded in the face of the interior flange 22. As will be apparent in FIG. 3, when the lid 12 is assembled upon the container 11, with the upper margin 25 of the walls being received within the channel 24, the respective adjacent surfaces will be urged into engagement with the gaskets 22 and 24 due to the clamping action of the flanges 22 and 23 upon the upper margin of the walls. Thus, a highly effective triple moisture barrier is created wherein entry of moisture would require that it move upwardly between the abutting faces 29 and 30 and past the first gasket 33, over the tops 26 of the walls, and past the gasket 34.

It will thus be apparent that the mechanism 21 securely engages the lid to the container when in place. In order to assist in disengaging the securing mechanism 21 when it is desired to gain access to the vault, the flat cover 20 may include a peripheral extension 35 projecting outwardly beyond the securing mechanism. Thus, by manually grasping the extension 35 and flexing the cover 20 at the securing mechanism 21, the projection 27 can be released from the recess 28 and the lid progressively removed.

As hereinabove mentioned, interior dividers may be provided to facilitate storage of articles within the vault. For example, as illustrated in FIGS. 1 and 2, spaced pairs of retainer strips 36 may be provided at selected locations along the interior surfaces of the side and end walls 13, 14, 15 and 16. Moveable divider walls 37 are then inserted between corresponding pairs of retainer strips in either the longitudinal or transverse direction as desired. The interior space may be further subdivided to provide multiple decking or layers as illustrated in FIG. 2, by employing shorter divider walls 38 in conjunction with two or more of the pairs of retainer strips 36, and supporting intermediate deck members 39 upon the tops of the divider walls 38. The deck member may, of course, extend over all or any portion of the receptacle.

Figure 4:
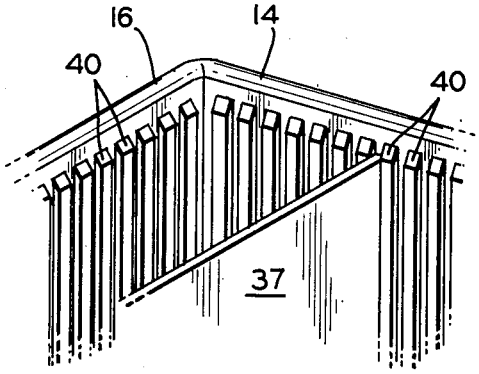
FIG. 4 is a fragmentary perspective view of an alternate embodiment of the invention.

It is also contemplated that in place of the retainer strips 36, the walls 13, 14, 15 and 16 may be formed with an interior surface entirely comprised of vertically extending corrugations or ribs 40, as illustrated in FIG. 4, so that the divider walls 37 and 38 may be inserted between the adjacent corrugations or ribs 40 at any location and in either direction within the receptacle. For convenience, the vault may be supplied to the user with a number of the component divider walls 37 and 38 and intermediate deck members 39 of different dimensions so as to provide a wide range of options in subdividing the interior.

It is thus believed apparent there is provided in accordance with the invention a durable and inexpensive means for storing valuables which affords the user privacy and confididentiality. The vault will neither be apparent to persons surreptitiously entering the premises nor susceptible to destruction by the elements of nature such as fire and windstorm.

It is to be understood that the forms of the invention herewith shown and described are to be taken as illustrative embodiments only of the same, and that various changes in the shape, size and arrangement of parts may be resorted to without departing from the spirit of the invention.

I claim:

1. A storage vault for valuables adapted to be removably buried in the earth, comprising a container of a durable, moisture-impervious, non-magnetic material, a flange extending around the periphery of and projecting outwardly from said container and into the earth surrounding said vault to thereby anchor said vault in the earth and resist upward movement due to buoyant forces acting thereon, a lid of similar material for said container, and means releasably affixing said lid to said container continuously around the juncture of said container and lid for locking said lid in place and preventing entry of moisture into said container while said vault is embedded in the earth, said container including pairs of upstanding side and end walls and a bottom wall, said means affixing said lid to said container comprising a continuous channel upon said lid for receiving the upper margins of said side and end walls, said lid including a flat cover extending over said container, said continuous channel being defined by spaced interior and exterior flanges depending from said flat cover, with said upper margins of said side and end walls being received between said interior and exterior flanges, a projection extending around the exterior periphery of said upper margins of said side and end walls having a downwardly and outwardly sloping upper surface terminating in a lip, and a mating recess in said exterior flange for receiving said projection, said recess having a sloping face abutting said sloping upper surface and a bottom wall for engaging beneath said lip to hold said sloping face in engagement with said sloping upper surface whereby moisture is effectively prevented from passing between said abutting surface and face, a first gasket member extending around the exterior of said side and end walls of said container and a second gasket member extending around the outer face of said interior flange, whereby said first and second gasket members seal between said upper wall margins and said interior and exterior flanges within said continuous channel.

2. A storage vault as claimed in claim 1, wherein said flat cover includes an extension projecting outwardly beyond said means for affixing said lid to said container by which said cover can be manually flexed at said affixing means for releasing said projection from said recess.

3. A storage vault as claimed in claim 1, wherein said container includes at least one upstanding divider wall for extending between a pair of said opposed walls, and retaining means on the interior of said side and end walls for supporting said divider wall whereby said divider wall may be positioned at selected locations along said walls to subdivide said container into a plurality of storage compartments.

4. A storage vault as claimed in claim 3, wherein said retaining means comprises pairs of spaced retainer strips affixed to said walls, the marginal ends of said divider wall being received in the recesses between said pairs of spaced strips.

5. A storage vault as claimed in claim 3, wherein the inner surfaces of said side and end walls are formed with vertically oriented ribs, the marginal ends of said divider wall being adapted for reception in the slots between selected ones of said ribs on said opposed walls.

6. A storage vault for valuables adapted to be removably buried in the earth, comprising a container of a durable, moisture-impervious non-magnetic material, said container including opposed pairs of upstanding side and end walls and a bottom wall, a lid including a flat cover for said container, means releasably affixing said lid to said container continuously around the juncture of said container and lid, said affixing means including a continuous channel upon said lid for receiving the upper margins of said side and end walls, said continuous channel being defined by spaced interior and exterior flanges depending from said flat cover, a projection extending around the exterior periphery of said upper margins of said side and end walls, said projection having a downwardly and outwardly sloping upper surface terminating in a lip, a mating recess in said exterior flange for receiving said projection, said recess having a sloping face abutting said sloping upper surface and a bottom wall for engaging beneath said lip to hold said sloping face in engagement with said sloping upper surface whereby moisture is effectively prevented from passing there between, a first gasket member extending around the exterior of said side and end walls, a second gasket member extending around the outer face of said interior flange, said first and second gasket members sealing between said upper wall margins and said interior and exterior flanges within said continuous channel, a flange projecting outwardly around the periphery of said container and into the earth surrounding said vault to thereby anchor said vault in the earth and resist upward movement due to buoyant forces acting upon said vault, an upstanding divider wall for extending between a pair of said opposed walls, and retaining means on said side and end walls for supporting said divider wall whereby said divider wall may be positioned at selected locations along said walls to subdivide said container into a plurality of storage compartments.

7. A storage vault for valuables as claimed in claim 6, wherein said flat cover includes an extension projecting outwardly beyond said means for affixing said lid to said container by means of which said cover can be manually flexed at said affixing means for releasing said projection from said recess.

8. A storage vault for valuables as claimed in claim 6, wherein said retaining means comprises a plurality of vertically oriented slots, the marginal ends of said divider wall being adapted for reception within selected pairs of said slots on said opposed walls.

* * * * *